US012291821B2

(12) United States Patent
Isozaki et al.

(10) Patent No.: US 12,291,821 B2
(45) Date of Patent: May 6, 2025

(54) HEAT-SEALABLE PAPER AND PACKAGING BAG

(71) Applicant: OJI HOLDINGS CORPORATION, Tokyo (JP)

(72) Inventors: Tomofumi Isozaki, Tokyo (JP); Yasutomo Noishiki, Tokyo (JP); Masahiro Tsuruhara, Tokyo (JP); Yuta Shamoto, Tokyo (JP); Miyoko Tanaka, Tokyo (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 169 days.

(21) Appl. No.: 17/927,651

(22) PCT Filed: May 21, 2021

(86) PCT No.: PCT/JP2021/019315
§ 371 (c)(1),
(2) Date: Nov. 23, 2022

(87) PCT Pub. No.: WO2021/241427
PCT Pub. Date: Dec. 2, 2021

(65) Prior Publication Data

US 2023/0243106 A1 Aug. 3, 2023

(30) Foreign Application Priority Data

May 27, 2020 (JP) ..... 2020-091869
Dec. 25, 2020 (JP) ..... 2020-217000

(51) Int. Cl.

| | |
|---|---|
| ***D21H 27/10*** | (2006.01) |
| ***B65D 65/02*** | (2006.01) |
| ***B65D 65/40*** | (2006.01) |
| ***D21H 11/04*** | (2006.01) |
| ***D21H 19/40*** | (2006.01) |
| ***D21H 19/58*** | (2006.01) |
| ***D21H 19/60*** | (2006.01) |

(52) U.S. Cl.
CPC ..... *D21H 27/10* (2013.01); *B65D 65/02* (2013.01); *B65D 65/40* (2013.01); *D21H 11/04* (2013.01); *D21H 19/40* (2013.01); *D21H 19/58* (2013.01); *D21H 19/60* (2013.01)

(58) Field of Classification Search
CPC ..... D21H 27/10; D21H 11/04; D21H 19/40; D21H 19/58; D21H 19/60; D21H 19/18; D21H 19/22; D21H 19/72; D21H 19/20; B65D 65/02; B65D 65/40
See application file for complete search history.

(56) References Cited

U.S. PATENT DOCUMENTS

| | | | | | |
|---|---|---|---|---|---|
| 4,600,404 | A * | 7/1986 | Sheldon | C09J 123/08 604/387 |
| 4,817,788 | A * | 4/1989 | Bedenk | C11D 17/046 206/820 |
| 5,576,364 | A * | 11/1996 | Isaac | A61L 15/62 524/80 |
| 5,580,910 | A * | 12/1996 | Isaac | B29C 73/163 525/54.3 |
| 6,887,537 | B2 * | 5/2005 | Bean | B29D 22/00 428/34.3 |
| 9,758,931 | B2 * | 9/2017 | Jolly | D21H 23/36 |
| 2004/0024102 | A1 | 2/2004 | Hayes et al. | |
| 2004/0265525 | A1 * | 12/2004 | Bean | D04H 1/64 428/36.3 |
| 2011/0003096 | A1 * | 1/2011 | Holbert | B32B 27/32 428/483 |
| 2015/0305814 | A1 * | 10/2015 | Jolly | D21H 17/36 162/168.7 |
| 2018/0135251 | A1 | 5/2018 | Constant et al. | |
| 2018/0200783 | A1 | 7/2018 | Takamura et al. | |
| 2023/0243106 | A1 * | 8/2023 | Isozaki | D21H 19/60 162/135 |

FOREIGN PATENT DOCUMENTS

| | | | | |
|---|---|---|---|---|
| CN | 1708532 | A | 12/2005 | |
| EP | 0220904 | B1 * | 4/1993 | C11D 17/04 |
| EP | 2963178 | B1 * | 6/2016 | B31F 1/126 |
| EP | 3088606 | A1 * | 11/2016 | D21H 11/08 |
| EP | 2917408 | B1 * | 9/2019 | A61B 50/30 |
| EP | 4328022 | A1 * | 2/2024 | |
| EP | 4382667 | A1 * | 6/2024 | D21H 19/72 |
| JP | 55108432 | A | 8/1980 | |
| JP | 63-75049 | A | 4/1988 | |
| JP | 03071830 | A * | 3/1991 | |
| JP | 05147664 | A * | 6/1993 | B65D 33/26 |
| JP | 06-200498 | A | 7/1994 | |
| JP | 07-22944 | U | 4/1995 | |

(Continued)

OTHER PUBLICATIONS

Machine Translation of JPH 05147664 A. (Year: 1993).*

(Continued)

*Primary Examiner* — Jose A Fortuna
(74) *Attorney, Agent, or Firm* — Sughrue Mion, PLLC

(57) ABSTRACT

An object is to provide heat-sealable paper that is excellent in impact resistance and workability. Provided is heat-sealable paper comprising at least one heat-sealable layer on at least one surface of a paper substrate, wherein in the paper substrate, when a tensile energy absorption in a vertical direction as measured in accordance with JIS P 8113:2006 is defined as $X_1$, a tensile energy absorption in a horizontal direction as measured in accordance with JIS P 8113:2006 is defined as $Y_1$, a tensile energy absorption index in a vertical direction as measured in accordance with JIS P 8113:2006 is defined as $X_2$, and a tensile energy absorption index in a horizontal direction as measured in accordance with JIS P 8113:2006 is defined as $Y_2$, a geometric mean of $X_1$ and $Y_1$ is 120 J/m$^2$ or more, a ratio of $X_1$ to $Y_1$ ($X_1/Y_1$) is 0.5 or more and 2.0 or less, and a geometric mean of $X_2$ and $Y_2$ is 2.0 J/g or more.

12 Claims, No Drawings

(56) References Cited

FOREIGN PATENT DOCUMENTS

| | | | | | |
|---|---|---|---|---|---|
| JP | 09-111697 | A | | 4/1997 | |
| JP | 2001-329490 | A | | 11/2001 | |
| JP | 2004067219 | A | * | 3/2004 | |
| JP | 2005-145561 | A | | 6/2005 | |
| JP | 2007154322 | A | * | 6/2007 | |
| JP | 2007-262211 | A | | 10/2007 | |
| JP | 4803586 | B2 | | 10/2011 | |
| JP | 2013-159866 | A | | 8/2013 | |
| JP | 2014-55372 | A | | 3/2014 | |
| JP | 2015147379 | A | * | 8/2015 | |
| JP | 2017-044623 | A | | 3/2017 | |
| JP | 2017-523317 | A | | 8/2017 | |
| JP | 2018-524199 | A | | 8/2018 | |
| JP | 6421404 | B2 | * | 11/2018 | |
| JP | 6580291 | B1 | | 9/2019 | |
| JP | 6625081 | B2 | * | 12/2019 | ..... B65D 25/36 |
| JP | 2020-066216 | A | | 4/2020 | |
| JP | 2022167766 | A | * | 11/2022 | ..... B32B 27/10 |
| JP | 2022168003 | A | * | 11/2022 | ..... B32B 27/10 |
| JP | 2022179386 | A | * | 12/2022 | |
| JP | 7205654 | B2 | * | 1/2023 | |
| JP | 2023184110 | A | * | 12/2023 | |
| JP | 2024009045 | A | * | 1/2024 | |
| KR | 100198485 | B1 | * | 6/1999 | ..... B29D 30/0681 |
| SE | 2230229 | A1 | * | 1/2024 | ..... D21H 27/32 |
| WO | WO-9101398 | A1 | * | 2/1991 | ..... D04H 1/70 |
| WO | WO-2007078537 | A1 | * | 7/2007 | ..... D06M 15/227 |
| WO | WO-2014071986 | A1 | * | 5/2014 | ..... A61B 50/30 |
| WO | 2018200783 | A1 | | 11/2018 | |
| WO | WO-2019107025 | A1 | * | 6/2019 | ..... B32B 27/28 |
| WO | WO-2021106926 | A1 | * | 6/2021 | |
| WO | WO-2022225042 | A1 | * | 10/2022 | ..... B32B 27/10 |

OTHER PUBLICATIONS

Machine Translation of JPH 0371830 A. (Year: 1991).*
Machine Translation of JPH 0722944 U. (Year: 1995).*
Machine Translation of JP 2014233407 A (Year: 2014).*
Machine Translation of WO 2019/107025 A (Year: 2020).*
Extended European Search Report issued May 27, 2024 in Application No. 21813508.5.
Notification of Reasons for Refusal dated Apr. 6, 2021 from the Japanese Patent Office in Application No. 2020-217000.
"Pulp and Paper Encyclopedia", Edited by Pulp and Paper Technology Association, <Revised 5th Edition>, pp. 1-6.
International Search Report of PCT/JP2021/019315 dated Aug. 10, 2021 [PCT/ISA/210].
Communication issued Feb. 19, 2025 in European Application No. 21813508.5.

* cited by examiner

HEAT-SEALABLE PAPER AND PACKAGING BAG

CROSS REFERENCE TO RELATED APPLICATIONS

This application is a National Stage of International Application No. PCT/JP2021/019315, filed May 21, 2021, claiming priorities to Japanese Patent Application No. 2020-091869, filed May 27, 2020 and Japanese Patent Application No. 2020-217000, filed Dec. 25, 2020.

TECHNICAL FIELD

The present invention relates to heat-sealable paper and a packaging bag using the heat sealable paper.

BACKGROUND ART

Packages using the heat sealing method have been widely used for packaging foods, medicines, medical devices, etc., other than packaging general industrial products.

In recent years, the problem of plastic waste is getting worse. Of the world's plastic production, the packaging sector accounts for a large portion of the plastic production, which is one of the causes of plastic waste. Plastics do not decompose semi-permanently, and their garbage turns into microplastics in the natural environment, which has a serious adverse effect on the ecosystem. As a countermeasure, it has been proposed to replace plastics with paper.

For example, JP 6580291 B discloses heat-sealable paper in which two or more heat-sealable layers containing an ionomer are formed on at least one surface of a paper substrate.

SUMMARY OF INVENTION

However, the heat-sealable paper described in JP 6580291 B had problems of poor impact resistance and poor workability.

Therefore, it is an object of the present invention to provide heat-sealable paper that is excellent in impact resistance and workability, and a packaging bag using the heat sealable paper.

The object of the present invention can be achieved by the following configuration.

<1> Heat-sealable paper comprising at least one heat sealable layer on at least one surface of a paper substrate, wherein in the paper substrate, when a tensile energy absorption in a vertical direction as measured in accordance with JIS P 8113:2006 is defined as $X_1$, a tensile energy absorption in a horizontal direction as measured in accordance with JIS P 8113:2006 is defined as $Y_1$, a tensile energy absorption index in a vertical direction as measured in accordance with JIS P 8113:2006 is defined as $X_2$, and a tensile energy absorption index in a horizontal direction as measured in accordance with JIS P 8113:2006 is defined as $Y_2$, a geometric mean of $X_1$ and $Y_1$ is 120 J/m$^2$ or more, the ratio of $X_1$ to $Y_1$ ($X_1/Y_1$) is 0.5 or more and 2.0 or less, and a geometric mean of $X_2$ and $Y_2$ is 2.0 J/g or more.

<2> The heat sealable paper according to <1>, wherein the paper substrate substantially consists of raw material pulp containing softwood pulp as a main component.

<3> The heat-sealable paper according to <1> or <2>, wherein the raw material pulp constituting the paper substrate is unbleached kraft pulp.

<4> The heat-sealable paper according to any one of <1> to <3>, wherein the pulp constituting the paper substrate has a kappa number as measured in accordance with JIS P 8211:2011 of 30 or more and 60 or less.

<5> The heat-sealable paper according to any one of <1> to <4>, wherein the paper substrate has a basis weight of 120 g/m$^2$ or less.

<6> The heat sealable paper according to any one of <1> to <5>, wherein the heat-sealable layer comprises a water dispersible resin binder, and wherein the water-dispersible resin binder is at least one selected from the group consisting of an ethylene-vinyl acetate copolymer, an ethylene-(meth)acrylic acid copolymer, and a styrene/butadiene copolymer.

<7> The heat-sealable paper according to any one of <1> to <6>, wherein a content of the water-dispersible resin binder in the heat-sealable layer is 30 mass % or more and 98 mass % or less.

<8> The heat-sealable paper according to any one of <1> to <7>, wherein the heat-sealable layer further comprises a lubricant.

<9> The heat-sealable paper according to <8>, wherein the lubricant is at least one selected from the group consisting of polyethylene wax, carnauba wax, and paraffin wax.

<10> The heat sealable paper according to <8> or <9>, wherein a content of the lubricant in the heat-sealable layer is 0.2 mass % or more and 30 mass % or less.

<11> The heat-sealable paper according to any one of <1> to <10>, wherein the heat-sealable layer further comprises at least one selected from a pigment and a silane coupling agent.

<12> The heat-sealable paper according to any one of <1> to <11>, having a pulp recovery rate after re-disintegration of 85% or more.

<13> Heat-sealable paper comprising at least one heat sealable layer on at least one surface of a paper substrate, wherein in the heat sealable paper, when a tensile energy absorption in a vertical direction as measured in accordance with JIS P 8113:2006 is defined as $X_{1a}$, a tensile energy absorption in a horizontal direction as measured in accordance with JIS P 8113:2006 is defined as $Y_{1a}$, a tensile energy absorption index in a vertical direction as measured in accordance with JIS P 8113:2006 is defined as $X_{2a}$, and a tensile energy absorption index in a horizontal direction as measured in accordance with JIS P 8113:2006 is defined as $Y_{2a}$, a geometric mean of $X_{1a}$ and $Y_{1a}$ is 120 J/m$^2$ or more, a ratio of $X_{1a}$ to $Y_{1a}$ ($X_{1a}/Y_{1a}$) is 0.5 or more and 2.0 or less, and a geometric mean of $X_{2a}$ and $Y_{2a}$ is 2.0 J/g or more.

<14> A packaging bag using the heat sealable paper according to any one of <1> to <13>.

DESCRIPTION OF EMBODIMENTS

Hereinafter, the preferable embodiments of the present invention will be described. In this description, "X to Y" showing a range means a range of "X or more and Y or less". When numerical ranges are stated stepwise, the upper and lower limits of each numerical range can be combined arbitrarily. In this specification, unless otherwise specified, operations and measurements of physical properties and the like are performed under the conditions of room temperature (20 to 25° C.)/relative humidity of 40 to 50% RH. Further, the term "(meth)acrylic" collectively refers to acrylic and methacrylic.

<Heat-Sealable Paper>

The heat sealable paper according to the first embodiment of the present invention (which may be hereinafter referred to simply as "heat-sealable paper") comprises at least one heat-sealable layer on at least one surface of a paper substrate, wherein in the paper substrate, when the tensile energy absorption in the vertical direction as measured in accordance with JIS P 8113:2006 is defined as $X_1$, the tensile energy absorption in the horizontal direction as measured in accordance with JIS P 8113:2006 is defined as $Y_1$, the tensile energy absorption index in the vertical direction as measured in accordance with JIS P 8113:2006 is defined as $X_2$, and the tensile energy absorption index in the horizontal direction as measured in accordance with JIS P 8113:2006 is defined as $Y_2$, the geometric mean of $X_1$ and $Y_1$ is 120 J/m$^2$ or more, the ratio of $X_1$ to $Y_1$ ($X_1/Y_1$) is 0.5 or more and 2.0 or less, and the geometric mean of $X_2$ and $Y_2$ is 2.0 J/g or more.

Further, the heat-sealable paper according to the second embodiment of the present invention comprises at least one heat-sealable layer on at least one surface of a paper substrate, wherein in the heat-sealable paper, when the tensile energy absorption in the vertical direction as measured in accordance with JIS P 8113:2006 is defined as $X_{1a}$, the tensile energy absorption in the horizontal direction as measured in accordance with JIS P 8113:2006 is defined as $Y_{1a}$, the tensile energy absorption index in the vertical direction as measured in accordance with JIS P 8113:2006 is defined as $X_{2a}$, and the tensile energy absorption index in the horizontal direction as measured in accordance with JIS P 8113:2006 is defined as $Y_{2a}$, the geometric mean of $X_{1a}$ and $Y_{1a}$ is 120 J/m$^2$ or more, the ratio of $X_{1a}$ to $Y_{1a}$ ($X_{1a}/Y_{1a}$) is 0.5 or more and 2.0 or less, and the geometric mean of $X_{2a}$ and $Y_{2a}$ is 2.0 J/g or more.

When the heat sealable paper of such an embodiment is used, a packaging bag that is excellent in impact resistance and hard to break when formed into a sealed bag can be obtained. Further, the heat-sealable paper of the embodiment is excellent in impact resistance even with a low basis weight and therefore has low rigidity and good softness. Therefore, it is easy to process with a packaging machine. The descriptions such as "the heat-sealable paper of the embodiment" refer to both the heat-sealable paper of the first embodiment and the heat-sealable paper of the second embodiment described above, unless otherwise specified.

[Paper Substrate]

(Raw Material Pulp)

The paper substrate used for the heat sealable paper of the embodiment preferably substantially consists of raw material pulp containing softwood pulp as a main component. The "raw material pulp containing softwood pulp as a main component" refers to raw material pulp in which the content of softwood pulp is over 50 mass %, and the content of softwood pulp is preferably 80 mass % or more, more preferably 90 mass % or more, further preferably 100 mass %. The average fiber length of the softwood pulp is long, and paper substrates using softwood pulp as raw material pulp tend to have excellent impact resistance and excellent workability. The phrase "the paper substrate substantially consists of raw material pulp" means that the content of the raw material pulp in the paper substrate is 95 mass % or more (the upper limit is 100 mass % or less), and the paper substrate may further contain components other than the raw material pulp in the aforementioned case.

The softwood pulp is preferably pulp obtained from one or more selected from the group consisting of Douglas fir and pine tree, more preferably pulp obtained from Douglas fir, for obtaining heat-sealable paper having excellent impact resistance and excellent workability.

The raw material pulp constituting the paper substrate is preferably one or more selected from the group consisting of bleached kraft pulp and unbleached kraft pulp, more preferably unbleached kraft pulp.

(Kappa Number)

The pulp constituting the paper substrate preferably has a kappa number as measured in accordance with JIS P 8211: 2011 of 30 or more and 60 or less, more preferably 55 or less, further preferably 50 or less, further preferably 46 or less, for obtaining heat sealable paper having impact resistance and workability. The kappa number of the pulp constituting the paper substrate is measured in accordance with JIS P 8211:2011, using a paper substrate pulp disintegrated in accordance with JIS P 8220-1:2012 as a sample.

(Tensile Energy Absorption (TEA))

In the paper substrate used for the heat-sealable paper of the embodiment, when the tensile energy absorption in the vertical direction as measured in accordance with JIS P 8113:2006 is defined as $X_1$, and the tensile energy absorption in the horizontal direction as measured in accordance with JIS P 8113:2006 is defined as $Y_1$, the geometric mean of $X_1$ and $Y_1$ is 120 J/m$^2$ or more, and the ratio of $X_1$ to $Y_1$ ($X_1/Y_1$) is 0.5 or more and 2.0 or less. Use of a paper substrate having TEA physical properties falling within such a range enables heat-sealable paper having the TEA physical properties of the second embodiment to be obtained.

The geometric mean of $X_1$ and $Y_1$ (square root of the product of $X_1$ and $Y_1$) is preferably 150 J/m$^2$ or more, more preferably 160 J/m$^2$ or more, further preferably 170 J/m$^2$ or more, furthermore preferably 180 J/m$^2$ or more, still more preferably 200 J/m$^2$ or more, for further improving the effects of this embodiment. The upper limit of the geometric mean of $X_1$ and $Y_1$ is not specifically limited and is preferably 400 J/m$^2$ or less.

The ratio of $X_1$ to $Y_1$ ($X_1/Y_1$) is preferably 0.8 or more, more preferably 1.0 or more, for further improving the effects of this embodiment. The ratio of $X_1$ to $Y_1$ ($X_1/Y_1$) is preferably 1.8 or less, more preferably 1.6 or less, further preferably 1.5 or less.

(Tensile Energy Absorption Index (TEAI))

In the paper substrate used for the heat-sealable paper of the embodiment, when the tensile energy absorption index in the vertical direction as measured in accordance with JIS P 8113:2006 is defined as $X_2$, and the tensile energy absorption index in the horizontal direction as measured in accordance with JIS P 8113:2006 is defined as $Y_2$, the geometric mean of $X_2$ and $Y_2$ is 2.0 J/g or more. Use of a paper substrate having TEAI physical properties falling within such a range enables heat sealable paper having the TEAI physical properties of the second embodiment to be obtained.

The geometric mean of $X_2$ and $Y_2$ (square root of the product of $X_2$ and $Y_2$) is preferably 2.1 J/g or more, more preferably 2.4 J/g or more, for further improving the effects of this embodiment. The upper limit of the geometric mean of $X_2$ and $Y_2$ is not specifically limited and is preferably 5.0 J/g or less, more preferably 4.0 J/g or less.

(Basis Weight)

The basis weight of the paper substrate is not specifically limited and is preferably 50 g/m$^2$ or more, more preferably 60 g/m$^2$ or more, further preferably 70 g/m$^2$ or more, and preferably 150 g/m$^2$ or less, more preferably 140 g/m$^2$ or less, further preferably 120 g/m$^2$ or less, furthermore preferably 110 g/m$^2$ or less, for obtaining heat sealable paper having impact resistance and workability. The basis weight of the paper substrate is measured in accordance with JIS P 8124:2011.

(Thickness)

The thickness of the paper substrate is preferably 20 μm or more, more preferably 30 μm or more, further preferably 40 μm or more, furthermore preferably 60 μm or more, still more preferably 80 μm or more, and preferably 200 μm or less, more preferably 180 μm or less, further preferably 160 μm or less, for obtaining heat sealable paper having impact resistance and workability. The thickness of the paper substrate is measured in accordance with JIS P 8118:2014.

(Density)

The density of the paper substrate is preferably 0.3 g/cm$^3$ or more, more preferably 0.5 g/cm$^3$ or more, and preferably 1.2 g/cm$^3$ or less, more preferably 1.0 g/cm$^3$ or less, in view of formability. The density of the paper substrate is calculated from the basis weight and the thickness of the paper substrate obtained by the aforementioned measurement methods.

(Optional Components)

The paper substrate may contain optional components including internal additives such as anionic, cationic, or amphoteric retention aids, drainage aids, dry paper strength additives, wet paper strength additives, sizing agents, and fillers, waterproofing agents, dyes, and fluorescent whitening agents, as required.

Examples of the dry paper strength additives include cationized starch, polyacrylamide, and carboxymethylcellulose. The content of the dry paper strength additives is not specifically limited and is preferably 3.0 mass % or less per raw material pulp (absolute dry mass).

Examples of the wet paper strength additives include polyamide polyamine epichlorohydrin, urea formaldehyde resin, and melamine formaldehyde resin.

Examples of the sizing agents include internal sizing agents such as rosin sizing agents, synthetic sizing agents, and petroleum resin sizing agents, and surface sizing agents such as styrene-acrylic acid copolymers and styrene-methacrylic acid copolymers. The content of the sizing agents is not specifically limited and is preferably 3.0 mass % or less per raw material pulp (absolute dry mass).

Examples of fixing agents include aluminum sulfate and polyethyleneimine. The content of the fixing agents is not specifically limited and is preferably 3.0 mass % or less per raw material pulp (absolute dry mass).

Examples of the fillers include inorganic fillers such as talc, kaolin, calcined kaolin, calcium carbonate, calcium sulfate, barium sulfate, titanium dioxide, zinc oxide, alumina, magnesium carbonate, magnesium oxide, silica, white carbon, bentonite, zeolite, sericite, and smectite, and organic fillers such as acrylic resins and vinylidene chloride resins.

As the paper substrate, Clupak paper or the like which has been subjected to Clupak treatment for shrinking paper strip can be used, for example.

[Heat-Sealable Layer]

The heat-sealable paper according to this embodiment comprises at least one heat-sealable layer on at least one surface of a paper substrate. The heat-sealable layer is a layer that is melted and adheres by heating, ultrasonic waves, or the like. The heat-sealable paper according to this embodiment preferably has two or more heat-sealable layers on at least one surface of a paper substrate, for forming a heat sealable layer uniformly on the paper substrate without defects. At this time, two or more heat sealable layers may have the same composition or different compositions.

(Water-Dispersible Resin Binder)

The heat sealable layer preferably contains a water-dispersible resin binder. The water-dispersible resin binder is a resin binder that is not water-soluble (specifically, the solubility in water at 25° C. is 10 g/L or less) but is finely dispersed in water like an emulsion or a suspension. Aqueous application of the heat-sealable layer using a water-dispersible resin binder enables heat-sealable paper that is excellent in re-disintegration property and can be recycled as paper to be obtained. In the case where the water-dispersible resin binder also corresponds to the following lubricant, it is classified as a lubricant.

The polymer that forms the skeleton of the water-dispersible resin binder is not specifically limited, but examples thereof include polyolefin resins (such as polyethylene and polypropylene), an ethylene vinyl acetate copolymer, vinyl chloride resins, styrene resins, a styrene/butadiene copolymer, styrene/unsaturated carboxylic acid copolymers (such as styrene-(meth)acrylic acid copolymers), styrene/acrylic copolymers (such as styrene-(meth)acrylic acid ester copolymers), acrylic resins, acrylonitrile/styrene copolymers, acrylonitrile/butadiene copolymers, ABS resins, AAS resins, AES resins, vinylidene chloride resins, polyurethane resins, poly-4-methylpentene-1 resins, polybutene-1 resins, vinylidene fluoride resins, vinyl fluoride resins, fluorine resins, polycarbonate resins, polyamide resins, acetal resins, polyphenylene oxide resins, polyester resins (such as polyethylene terephthalate and polybutylene terephthalate), polyphenylene sulfide resins, polyimide resins, polysulfone resins, polyethersulfone resins, polyarylate resins, olefin/unsaturated carboxylic acid copolymers, and modified products thereof. One of these may be used alone, or two or more of these may be used in combination. Among these, an ethylene-vinyl acetate copolymer, olefin/unsaturated carboxylic acid copolymers, and/or a styrene/butadiene copolymer are preferable because of their high heat sealing strength. Among them, a styrene/butadiene copolymer is more preferable, in view of recyclability.

Examples of the olefin/unsaturated carboxylic acid copolymers include an ethylene-(meth)acrylic acid copolymer and ethylene-(meth)acrylic acid alkyl ester copolymers. Among them, an ethylene-(meth)acrylic acid copolymer is preferable, and an ethylene-acrylic acid copolymer is more preferable. Therefore, in a preferable embodiment, the water-dispersible resin binder contained in the heat-sealable layer is at least one selected from the group consisting of an ethylene-vinyl acetate copolymer, an ethylene-(meth)acrylic acid copolymer, and a styrene/butadiene copolymer. Further, an ethylene-(meth)acrylic acid copolymer is more preferable, for reducing contamination of the device during application and improving the runnability. The olefin/unsaturated carboxylic acid copolymers may be ionomers.

The ethylene-(meth)acrylic acid copolymer to be used may be any of synthetic products and commercially available products, and examples of the commercially available products include MFHS1279, MP498345N, MP4983R, and MP4990R, available from Michelman Japan LLC, ZAIKTHENE (R) A and ZAIKTHENE (R) AC, available from Sumitomo Seika Chemicals Company, Limited, and CHEMIPEARL S Series, available from Mitsui Chemicals, Inc.

The ethylene-vinyl acetate copolymer to be used may be any of synthetic products and commercially available products, and examples of the commercially available products include Sumikaflex S-201HQ, S-305, S-305HQ, S-400HQ, S-401HQ, S-408HQE, S-450HQ, S-455HQ, S-456HQ, S-460HQ, S-467HQ, S-470HQ, S-480HQ, S-510HQ, S-520HQ, S-752, and S-755, available from Sumika Chemtex Company, Limited, POLYSOL AD-2, AD-5, AD-6, AD-10, AD-11, AD-14, AD-56, AD-70, and AD-92, available from Showa Denko K.K., and AQUATEX EC1200, EC1400, EC1700, EC1800, and MC3800, available from Japan Coating Resin Corporation.

The styrene/butadiene copolymer to be used may be any of synthetic products and commercially available products, and examples of the commercially available products include Nipol LX407-F7, LX407-G51, LX407-S10, and LX407-S12, available from Zeon Corporation, and Nalstar SR-100, SR-102, and SR-103, available from NIPPON A&L INC.

The content of the water-dispersible resin binder in the heat-sealable layer is preferably 30 mass % or more, more preferably 40 mass % or more, further preferably 45 mass % or more, furthermore preferably 50 mass % or more, and preferably 100 mass % or less, more preferably 98 mass % or less, further preferably 90 mass % or less, furthermore preferably 80 mass % or less. Within such a range, heat sealable paper with high heat sealing strength can be obtained.

That is, according to one embodiment, the content of the ethylene-vinyl acetate copolymer, the ethylene-(meth) acrylic acid copolymer, and the styrene/butadiene copolymer in the heat-sealable layer is preferably 30 mass % or more, more preferably 40 mass % or more, further preferably 45 mass % or more, furthermore preferably 50 mass % or more, and preferably 100 mass % or less, more preferably 98 mass % or less, further preferably 90 mass % or less, furthermore preferably 80 mass % or less.

In the case where the water-dispersible resin binder is an ethylene-vinyl acetate copolymer, the content of the ethylene-vinyl acetate copolymer in the heat-sealable layer is preferably 50 mass % or more, more preferably 60 mass % or more, further preferably 65 mass % or more, furthermore preferably 70 mass % or more, and preferably 100 mass % or less, more preferably 90 mass % or less, further preferably 80 mass % or less.

Further, in the case where the water-dispersible resin binder is an ethylene-(meth)acrylic acid copolymer, the content of the ethylene-(meth)acrylic acid copolymer in the heat-sealable layer is preferably 30 mass % or more, more preferably 40 mass % or more, further preferably 45 mass % or more, furthermore preferably 50 mass % or more, and preferably 100 mass % or less, more preferably 98 mass % or less, further preferably 90 mass % or less, furthermore preferably 80 mass % or less, still more preferably 75 mass % or less.

Further, in the case where the water-dispersible resin binder is a styrene/butadiene copolymer, the content of the styrene/butadiene copolymer in the heat-sealable layer is preferably 50 mass % or more, more preferably 60 mass % or more, further preferably 70 mass % or more, furthermore preferably 80 mass % or more, and preferably 100 mass % or less, more preferably 98 mass % or less.

(Pigment)

For suppressing blocking of the heat sealable paper, the heat sealable layer preferably contains a pigment in addition to the water-dispersible resin binder.

The pigment is not specifically limited, and various pigments used for conventional pigment coating layers can be mentioned as examples. Specifically, examples thereof include various kaolins such as kaolin, calcined kaolin, structured kaolin, and delaminated kaolin, talc, heavy calcium carbonate (ground calcium carbonate), light calcium carbonate (synthetic calcium carbonate), composite synthetic pigments of calcium carbonate and another hydrophilic organic compound, satin white, lithopone, titanium dioxide, silica, barium sulfate, calcium sulfate, alumina, aluminum hydroxide, zinc oxide, magnesium carbonate, silicate, colloidal silica, plastic pigments of hollow or dense organic pigments, binder pigments, plastic beads, and microcapsules. Among these, since the effect of suppressing blocking is excellent, a kaolin is preferable. One of the pigments may be used alone, or two or more of them may be used in combination.

The average particle size of the pigment is not specifically limited and is preferably 0.1 μm or more, more preferably 0.3 μm or more, further preferably 0.5 μm or more, and preferably 30 μm or less, more preferably 20 μm or less, further preferably 10 μm or less, in view of the blocking resistance and the heat sealing property. The average particle size of the pigment is a value measured by a laser diffraction/scattering particle size distribution analyzer.

In the case where the heat-sealable layer contains a pigment, the content of the pigment is preferably 1 part by mass or more, more preferably 2 parts by mass or more, further preferably 5 parts by mass or more, furthermore preferably 15 parts by mass or more, still more preferably 30 parts by mass or more, and preferably 100 parts by mass or less, more preferably 80 parts by mass or less, further preferably 60 parts by mass or less, with respect to 100 parts by mass of the water-dispersible resin binder.

In the case where the heat-sealable layer contains a pigment, the content of the pigment in the heat sealable layer is preferably 1 mass % or more, more preferably 3 mass % or more, further preferably 5 mass % or more, and preferably 50 mass % or less, more preferably 40 mass % or less, further preferably 35 mass % or less.

(Lubricant)

For imparting a slip property to the heat sealable paper and suppressing blocking, the heat sealable layer preferably contains a lubricant in addition to the water-dispersible resin binder. The lubricant is a substance that can reduce the coefficient of friction on the surface of the heat-sealable layer by being mixed in the heat-sealable layer.

The lubricant is not specifically limited, and waxes, metal soaps, fatty acid esters, and the like can be used, for example. One of the lubricants may be used alone, two or more of them may be used in combination. Examples of the waxes include natural waxes including animal or plant-derived waxes (such as beeswax and carnauba wax), mineral waxes (such as microcrystalline wax), and petroleum wax; and synthetic waxes including polyethylene wax, paraffin wax, and polyester wax. Examples of the metal soaps include calcium stearate, sodium stearate, zinc stearate, aluminum stearate, magnesium stearate, fatty acid sodium soap, potassium oleate soap, castor oil potassium soap, and composites thereof. Among the lubricants, polyethylene wax is preferable since the melting point is high, the coating layer is less likely to soften in a comparatively high-temperature environment, and the effect of suppressing blocking is excellent. Further, carnauba wax is also preferable since the melting point is comparatively low, and wax components are easily formed on the surface of the coating layer, and the effect of suppressing blocking is excellent. Further, paraffin wax is also preferable since the effect of imparting the oil resistance and the water resistance is excellent, it is easily available in the market, and it is inexpensive. Accordingly, the lubricant is preferably at least one selected from the group consisting of polyethylene wax, carnauba wax, and paraffin wax. The polyethylene wax to be used may be any of synthetic products and commercially available products, and examples of the commercially available products include CHEMIPEARL W-310, available from Mitsui Chemicals, Inc. The carnauba wax to be used may be any of synthetic products and commercially available products, and examples of the commercially available products include Selosol 524, available from Chukyo Yushi Co., Ltd. The paraffin wax to be used may be any of synthetic products and commercially available products, and examples of the commercially available products include Hidorin L700, available from Chukyo Yushi Co., Ltd.

In the case where the heat-sealable layer contains a lubricant, the content of the lubricant is preferably 0.5 parts by mass or more, more preferably 1 part by mass or more, and preferably 50 parts by mass or less, more preferably 40 parts by mass or less, with respect to 100 parts by mass of the water-dispersible resin binder.

In the case where the heat-sealable layer contains a lubricant, the content of the lubricant in the heat-sealable layer is preferably 0.2 mass % or more, more preferably 0.5 mass % or more, and preferably 30 mass % or less, more preferably 20 mass % or less.

(Silane Coupling Agent)

In this embodiment, the heat sealable layer also preferably contains a silane coupling agent, for enhancing the peel strength (heat sealing peel strength) in heat sealing. The silane coupling agent may be contained in the heat sealable layer in the form of a reaction product.

The silane coupling agent is a compound having at least one alkoxysilyl group and at least one reactive functional group other than the alkoxysilyl group in the molecule. The alkoxysilyl group may be any of a monoalkoxysilyl group, a dialkoxysilyl group, and a trialkoxysilyl group but is preferably a trialkoxysilyl group in view of the reactivity.

Examples of the reactive functional group other than the alkoxysilyl group include vinyl groups, epoxy groups, styryl groups, (meth)acryloyloxy groups, amino groups, isocyanato groups, ureide groups, and acid anhydride groups. Among these, amino groups, epoxy groups, and acid anhydride groups are preferable, and amino groups are more preferable.

Examples of the epoxy group-containing silane coupling agent include 3-glycidoxypropyltrimethoxysilane, 3-glycidoxypropyltriethoxysilane, 3-glycidoxypropylmethyldiethoxysilane, and 2-(3,4-epoxycyclohexyl)ethyltrimethoxysilane.

Examples of the amino group-containing silane coupling agent include 3-aminopropyltrimethoxysilane, 3-aminopropyltriethoxysilane, N-2-(aminoethyl)-3-aminopropylmethyldimethoxysilane, N-2-(aminoethyl)-3-aminopropyltrimethoxysilane, 3-triethoxysilyl-N-(1,3-dimethylbutylidene) propylamine, and N-phenyl-3-aminopropyltrimethoxysilane. Among these, 3-aminopropyltriethoxysilane is preferable.

Examples of the acid anhydride group-containing silane coupling agent include 3-trimethoxysilylpropyl succinic anhydride.

The silane coupling agent to be used may be a commercially available product, and examples thereof include KBM-303, KBM-402, KBM-403, KBE-402, KBE-403, KBM-602, KBM-603, KBM-903, KBE-903, KBE-9103P, KBM-573, and X-12-967C, available from Shin-Etsu Chemical Co., Ltd.

The amount of the silane coupling agent to be mixed in the heat-sealable layer is preferably 0.03 mass % or more, more preferably 0.1 mass % or more, further preferably 0.2 mass % or more, furthermore preferably 0.3 mass % or more, and preferably 5.0 mass % or less, more preferably 3.0 mass % or less, further preferably 2.0 mass % or less, furthermore preferably 1.5 mass % or less, for enhancing the heat sealing peel strength.

In this embodiment, the heat-sealable layer preferably contains a water-dispersible resin binder, more preferably at least one of a pigment and silane coupling agent in addition to the water-dispersible resin binder, further preferably a lubricant in addition to the water-dispersible resin binder and at least one of the pigment and the silane coupling agent.

The heat sealable layer may further contain other components in addition to the water-dispersible resin binder, the pigment, the lubricant, and the silane coupling agent. Examples of the other components include colorants such as leveling agents; defoamers; viscosity modifiers; and coloring dyes.

<Physical Properties of Heat-Sealable Paper>

(Tensile Energy Absorption (TEA))

In the second heat-sealable paper of this embodiment, when the tensile energy absorption in the vertical direction as measured in accordance with JIS P 8113:2006 is defined as $X_{1a}$, and the tensile energy absorption in the horizontal direction as measured in accordance with JIS P 8113:2006 is defined as $Y_{1a}$, the geometric mean of $X_{1a}$ and $Y_{1a}$ is 120 J/m$^2$ or more, the ratio of $X_{1a}$ to $Y_{1a}$ ($X_{1a}/Y_{1a}$) is 0.5 or more and 2.0 or less.

For further improving the effects of this embodiment, the geometric mean of $X_{1a}$ and $Y_{1a}$ (square root of the product of $X_{1a}$ and $Y_{1a}$) is preferably 150 J/m$^2$ or more, more preferably 160 J/m$^2$ or more, further preferably 170 J/m$^2$ or more, furthermore preferably 180 J/m$^2$ or more, still more preferably 200 J/m$^2$ or more. The upper limit of the geometric mean of $X_{1a}$ and $Y_{1a}$ is not specifically limited and is preferably 400 J/m$^2$ or less.

For further improving the effects of this embodiment, the ratio of $X_{1a}$ to $Y_{1a}$ ($X_{1a}/Y_{1a}$) is preferably 0.8 or more, more preferably 1.0 or more. The ratio of $X_{1a}$ to $Y_{1a}$ ($X_{1a}/Y_{1a}$) is preferably 1.8 or less, more preferably 1.6 or less, further preferably 1.5 or less.

(Tensile Energy Absorption Index (TEAI))

In the heat sealable paper of the embodiment, when the tensile energy absorption index in the vertical direction as measured in accordance with JIS P 8113:2006 is defined as $X_{2a}$, and the tensile energy absorption index in the horizontal direction as measured in accordance with JIS P 8113: 2006 is defined as $Y_{2a}$, the geometric mean of $X_{2a}$ and $Y_{2a}$ is 2.0 J/g or more.

For further improving the effects of this embodiment, the geometric mean of $X_{2a}$ and $Y_{2a}$ (square root of the product of $X_{2a}$ and $Y_{2a}$) is preferably 2.1 J/g or more, more preferably 2.4 J/g or more. The upper limit of the geometric mean of $X_{2a}$ and $Y_{2a}$ is not specifically limited and is preferably 5.0 J/g or less, more preferably 4.0 J/g or less.

(Pulp Recovery Rate after Re-Disintegration)

The heat sealable paper of the embodiment preferably has a pulp recovery rate after re-disintegration of 85% or more, more preferably 90% or more, further preferably 95% or more, furthermore preferably 98% or more. The pulp recovery rate after re-disintegration falling within such a range allows excellent recyclability. The pulp recovery rate after re-disintegration of the heat-sealable paper is a value measured by the method according to Examples, which will be described below.

(Peel Strength)

In the heat-sealable paper of the embodiment, the peel strength of the heat-sealable layer is preferably 5.5 N/15 mm or more, more preferably 6.0 N/15 mm or more, further preferably 6.5 N/15 mm or more, and preferably 10 N/15 mm or less, more preferably 9.5 N/mm or less, further preferably 9.0 N/15 mm or less, furthermore preferably 8.5 N/15 mm or less, still more preferably 8.0 N/15 mm or less. The peel strength of the heat-sealable layer is a peel strength when two heat-sealable layers are heat-sealed under the conditions of 160° C., 0.2 MPa, and 1 second, specifically, is a value measured by the method according to Examples, which will be described below.

[Production Method of Heat Sealable Paper]

The production method of the heat-sealable paper of the embodiment is not specifically limited. Examples thereof include a production method comprising an application step of applying at least one heat-sealable layer on at least one surface of a paper substrate obtained by a method that comprises a cooking step of adjusting the kappa number of raw material pulp to 30 or more and 60 or less by cooking, a beating step of beating a dispersion containing 20 mass % or more and 45 mass % or less of the raw material pulp subjected to cooking, and a papermaking step of making paper from the raw material pulp subjected to beating. Each step of the production method will be described below.

(Cooking Step)

The cooking step is a step of conducting cooking to adjust the kappa number of the raw material pulp to preferably 30 or more and 60 or less. Although not specifically limited, raw material chips used as a material of the raw material pulp are treated with a chemical solution containing sodium hydroxide, thereby allowing raw material pulp having a kappa number of 30 or more and 60 or less to be obtained. As the method for treatment with a chemical solution containing sodium hydroxide, a known treatment method using a known chemical solution can be used.

Adjusting the kappa number of the raw material pulp to 30 or more and 60 or less allows the TEA physical properties and TEAI physical properties as described above to be satisfied, thereby allowing a paper substrate with impact resistance and workability and heat sealable paper using the paper substrate to be obtained. From this point of view, the kappa number of the raw material pulp is preferably 55 or less, more preferably 50 or less, further preferably 46 or less.

The raw material chips used as a material of the raw material pulp preferably contains softwood pulp as a main component. The "raw material chips containing softwood pulp as a main component" has a content of the softwood of over 50 mass %, preferably a content of the softwood of 80 mass % or more, more preferably 90 mass % or more, further preferably 100 mass %, in the raw material chips.

The raw material pulp may not be bleached or may be bleached. The raw material pulp is preferably one or more selected from the group consisting of bleached kraft pulp and unbleached kraft pulp, more preferably unbleached kraft pulp.

(Beating Step)

The beating step is a step of beating a dispersion preferably containing 20 mass % or more and 45 mass % or less of the raw material pulp subjected to cooking. The beating method is not specifically limited and preferably includes: dispersing, in water, the raw material pulp subjected to cooking, producing a dispersion having the above raw material pulp concentration, and subjecting the dispersion to beating. The beating method is not specifically limited and can be performed, for example, using a beater such as a double disk refiner, a single disk refiner, and a conical refiner.

Beating the dispersion containing 20 mass % or more and 45 mass % or less of the raw material pulp subjected to cooking allows the TEA physical properties and TEAI physical properties as described above to be satisfied, thereby allowing a paper substrate with impact resistance and workability and heat-sealable paper using the paper substrate to be obtained, as well as allowing excellent productivity.

(Papermaking Step)

The papermaking step is a step of making paper from the raw material pulp subjected to beating. The papermaking method is not specifically limited, and examples thereof include the acidic papermaking method in which papermaking is performed at a pH of around 4.5 and the neutral papermaking method in which papermaking is performed at a pH of about 6 to about 9. In the papermaking step, agents for papermaking step such as pH adjusters, defoamers, pitch control agents, and slime control agents can be appropriately added, as required. The paper machine is also not specifically limited, and examples thereof include Fourdrinier, cylindrical, and inclined continuous paper machines or multilayer paper machines that combine these.

The paper substrate used for the heat-sealable paper of the embodiment can be obtained by a method including the cooking step, the beating step, and the papermaking step. After the papermaking step, a Clupak step of shrinking the paper strip using Clupak equipment may be provided, as required. A known Clupak equipment can be used. The production method of the paper substrate used for the heat-sealable paper of the embodiment is not limited to the aforementioned method.

Further, the production method of the heat-sealable paper of the embodiment may include a surface treatment step of treating the surface of the paper substrate with an agent. Examples of the agent used for the surface treatment step include sizing agents, waterproofing agents, water retention agents, thickeners, and lubricants. A known device can be used for the surface treatment step.

The production method of the heat-sealable paper of the embodiment comprises an application step of applying the heat sealable layer on at least one surface of the paper substrate obtained as described above. The heat-sealable layer coating liquid (heat sealable layer coating material) may be applied twice or more.

In the case of forming multiple heat sealable layers on the paper substrate, the aforementioned method of sequentially forming the heat sealable layers is preferable, but there is no limitation to this. A simultaneous multilayer coating method may be employed. The simultaneous multilayer coating method is a method of discharging multiple types of coating liquids separately from slit-shaped nozzles to form a liquid laminate and applying the laminate to the paper substrate to form multiple heat-sealable layers simultaneously.

The application equipment for applying the heat sealable layer coating liquid to the paper substrate is not specifically limited, and known equipment may be used. Examples of the application equipment include blade coaters, bar coaters, air knife coaters, slit die coaters, gravure coaters, micro gravure coaters, roll coaters, size presses, gate roll coaters, and Sym-sizers.

The drying equipment for drying the heat sealable layer is not specifically limited, and known equipment can be used. Examples of the drying equipment include hot air dryers, infrared dryers, gas burners, and hot plates. Further, the drying temperature may be appropriately set in consideration of the drying time.

The solvent for the heat sealable layer coating liquid is not specifically limited, and water or an organic solvent such as ethanol, isopropyl alcohol, methyl ethyl ketone, and toluene can be used. Among these, water is preferable as a dispersion medium for the heat-sealable layer coating liquid, since there is no problem of volatile organic solvents. That is, the heat-sealable layer coating liquid is preferably an aqueous composition for heat sealable layers.

The solid content of the heat-sealable layer coating liquid is not specifically limited and may be appropriately selected in view of the coating property and ease of drying but is preferably 3 mass % or more, more preferably 5 mass % or more, further preferably 10 mass % or more, and preferably 80 mass % or less, more preferably 70 mass % or less, further preferably 60 mass % or less.

The total amount of the heat-sealable layer to be applied (after drying) is not particularly limited and is preferably 1 to 50 g/m$^2$, more preferably 2 to 30 g/m$^2$, furthermore preferably 5 to 20 g/m$^2$.

In the case where the heat-sealable paper of the embodiment has two or more heat-sealable layers, the amount to be applied (after drying) per layer is preferably 0.5 to 20 g/m$^2$, more preferably 1 to 10 g/m$^2$, furthermore preferably 2 to 5 g/m$^2$.

In the case where the heat-sealable paper of the embodiment has two or more heat-sealable layers, the ratio of the amount of the first layer (the heat-sealable layer on the paper substrate side) to be applied to the amount of the second layer to be applied (first layer/second layer) is preferably 30/70 or more and 70/30 or less, more preferably 40/60 or more and 60/40 or less, further preferably 45/55 or more and 55/45 or less.

<Applications>

The heat sealable paper according to this embodiment can be suitably used as a packaging bag for foods, household goods, commodities (soaps and diapers), and the like. Accordingly, this embodiment also provides a packaging bag using the heat-sealable paper.

According to the present invention, heat-sealable paper that is excellent in impact resistance and workability, and a packaging bag using the heat sealable paper can be obtained.

EXAMPLES

Hereinafter, examples will be mentioned in order to specifically describe this embodiment, but this embodiment is not limited to these examples. Unless otherwise specified, the following operations were performed under the conditions of 23° C. and a relative humidity of 50% RH. In the following examples and comparative examples, "parts" and "%" respectively refer to "parts by mass" and "mass %", unless otherwise specified.

Example 1

<Preparation of Heat-Sealable Layer Coating Material>

182 parts of an ethylene-vinyl acetate copolymer (Sumikaflex S-470HQ, available from Sumika Chemtex Company, Limited, solid content 55%), 52 parts of a low-molecular weight polyethylene wax dispersion (CHEMIPEARL W-310, available from Mitsui Chemicals, Inc., solid content 38.5%), and 20 parts of a 50% aqueous dispersion of kaolin A (average particle size 8 μm) were mixed, and water was added so that the solid content concentration was 40%, followed by stirring, to obtain a heat sealable layer coating material (concentration 40%). The ethylene-vinyl acetate copolymer had a solubility in water at 25° C. of 10 g/L or less.

<Production of Heat-Sealable Paper>

The heat-sealable layer coating material obtained was applied to super stretched paper (available from Oji Materia Co., Ltd., geometric mean of $X_1$ and $Y_1$: 320 J/m$^2$, ratio of $X_1$ to $Y_1$ ($X_1/Y_1$):1.2, geometric mean of $X_2$ and $Y_2$: 3.2 J/g, pulp type: unbleached conifer (Douglas fir) kraft pulp 100 mass %, kappa number of raw material pulp: 45, paper strength additive (0.8 mass % of polyacrylamide and 0.8 mass % of cationized starch (total 1.6 mass %)), sizing agent (0.2 mass % of synthetic sizing agent), and 1.0 mass % of aluminum sulfate) with a basis weight of 100 g/m$^2$, a thickness of 125 μm, and a density of 0.80 g/cm$^3$ with a gravure coater (using a smoothing bar), so that the amount of the heat-sealable layer to be applied after drying was 4 g/m$^2$, to form a first heat sealable layer. Thereafter, it was applied to the same surface again with a gravure coater (using a smoothing bar) so that the amount of the heat-sealable layer to be applied after drying was 4 g/m$^2$, to form a second heat-sealable layer.

In the paper substrate, $X_1$ represents a tensile energy absorption in the vertical direction as measured in accordance with JIS P 8113:2006, $Y_1$ represents a tensile energy absorption in the horizontal direction as measured in accordance with JIS P 8113:2006, $X_2$ represents a tensile energy absorption index in the vertical direction as measured in accordance with JIS P 8113:2006, and $Y_2$ represents a tensile energy absorption index in the horizontal direction as measured in accordance with JIS P 8113:2006. The same applies the following examples and comparative examples.

Example 2

Heat-sealable paper was obtained in the same manner as in Example 1 except that the paper substrate was changed to super stretched paper (available from Oji Materia Co., Ltd., geometric mean of $X_1$ and $Y_1$: 220 J/m$^2$, ratio of $X_1$ to $Y_1$ ($X_1/Y_1$):1.2, geometric mean of $X_2$ and $Y_2$: 2.8 J/g, pulp type: unbleached conifer (Douglas fir) kraft pulp 100 mass %, and kappa number of raw material pulp: 45) with a basis weight of 80 g/m$^2$, a thickness of 114 μm, and a density of 0.70 g/cm$^3$.

Example 3

Heat-sealable paper was obtained in the same manner as in Example 1 except that the amount of the first heat-sealable layer to be applied was changed to 8 g/m$^2$, and the application of the second heat sealable layer was omitted.

Comparative Example 1

Heat-sealable paper was obtained in the same manner as in Example 1 except that the paper substrate was changed to unbleached kraft paper (available from Oji Materia Co., Ltd., geometric mean of $X_1$ and $Y_1$: 65 J/m$^2$, ratio of $X_1$ to $Y_1$ ($X_1/Y_1$):1.2, and geometric mean of $X_2$ and $Y_2$: 0.8 J/g) with a basis weight of 80 g/m$^2$, a thickness of 113 μm, and a density of 0.71 g/cm$^3$.

Comparative Example 2

Heat-sealable paper was obtained in the same manner as in Example 1 except that the paper substrate was changed to unbleached kraft paper (available from Oji Materia Co., Ltd., geometric mean of $X_1$ and $Y_1$: 80 J/m$^2$, ratio of $X_1$ to $Y_1$ ($X_1/Y_1$):1.2, and geometric mean of $X_2$ and $Y_2$: 0.8 J/g) with a basis weight of 100 g/m$^2$, a thickness of 143 μm, and a density of 0.70 g/cm$^3$.

Comparative Example 3

Heat-sealable paper was obtained in the same manner as in Example 1 except that the paper substrate was changed to unbleached kraft paper (available from Oji Materia Co., Ltd., geometric mean of $X_1$ and $Y_1$: 90 J/m$^2$, ratio of $X_1$ to $Y_1$ ($X_1/Y_1$):1.2, and geometric mean of $X_2$ and $Y_2$: 0.8 J/g) with a basis weight of 120 g/m$^2$, a thickness of 173 μm, and a density of 0.70 g/cm$^3$.

Comparative Example 4

Heat-sealable paper was obtained in the same manner as in Example 1 except that the paper substrate was changed to unbleached kraft paper (available from Oji Materia Co., Ltd., geometric mean of $X_1$ and $Y_1$: 100 J/m$^2$, ratio of $X_1$ to $Y_1$ ($X_1/Y_1$):1.2, and geometric mean of $X_2$ and $Y_2$: 0.8 J/g) with a basis weight of 130 g/m$^2$, a thickness of 196 μm, and a density of 0.66 g/cm$^3$.

Example 4

Heat-sealable paper was obtained in the same manner as in Example 3 except that the heat sealable layer coating material of Example 3 was changed to a coating material prepared as follows.

<Preparation of Heat Sealable Layer Coating Material 2>

164 parts of an ethylene-acrylic acid copolymer (solid content 42%), 3.3 parts of a carnauba wax (solid content 30%), 60 parts of a 50% aqueous dispersion of kaolin A (average particle size 8 μm) were mixed, and water was added so that the solid content concentration was 35%, followed by stirring, to obtain a heat-sealable layer coating material (concentration 35%). The ethylene-acrylic acid copolymer had a solubility in water at 25° C. of 10 g/L or less.

Example 5

Heat-sealable paper was obtained in the same manner as in Example 4 except that, in the heat sealable layer coating material of Example 4, the amount of the ethylene-acrylic acid copolymer (solid content 42%) mixed was changed to 160 parts, and the amount of the carnauba wax (solid content 30%) mixed was changed to 10 parts.

Example 6

Heat-sealable paper was obtained in the same manner as in Example 4 except that, in the heat sealable layer coating material of Example 4, the amount of the ethylene-acrylic acid copolymer (solid content 42%) mixed was changed to 143 parts, and the amount of the carnauba wax (solid content 30%) mixed was changed to 33 parts.

Example 7

Heat-sealable paper was obtained in the same manner as in Example 4 except that, in the heat-sealable layer coating material of Example 4, the amount of the ethylene-acrylic acid copolymer (solid content 42%) mixed was changed to 124 parts, and the amount of the carnauba wax (solid content 30%) mixed was changed to 60 parts.

Example 8

Heat-sealable paper was obtained in the same manner as in Example 5 except that the amount of the first heat sealable layer to be applied was changed to 4 g/m$^2$, and the amount of the second heat-sealable layer to be applied was changed to 4 g/m$^2$.

Example 9

Heat-sealable paper was obtained in the same manner as in Example 4 except that the amount of the heat-sealable layer to be applied was changed to 6 g/m$^2$, and the heat sealable layer coating material of Example 4 was changed to a coating material prepared as follows.

<Preparation of Heat Sealable Layer Coating Material 3>

231 parts of an ethylene-acrylic acid copolymer (solid content 42%), 6.7 parts of a carnauba wax (solid content 30%), and 100 parts of a silane coupling agent (KBE-903, available from Shin-Etsu Chemical Co., Ltd., effective silane concentration 1%) were mixed, and water was added so that the solid content concentration was 27%, followed by stirring, to obtain a heat-sealable layer coating material (solid content concentration 27%).

Example 10

Heat-sealable paper was obtained in the same manner as in Example 9 except that, in the heat sealable layer coating material of Example 9, the amount of the ethylene-acrylic acid copolymer (solid content 42%) mixed was changed to 229 parts, and the amount of the carnauba wax (solid content 30%) mixed was changed to 10 parts.

Example 11

Heat-sealable paper was obtained in the same manner as in Example 9 except that, in the heat sealable layer coating material of Example 9, the amount of the ethylene-acrylic acid copolymer (solid content 42%) mixed was changed to 202 parts, and the amount of the carnauba wax (solid content 30%) mixed was changed to 47 parts.

Example 12

Heat-sealable paper was obtained in the same manner as in Example 9 except that, in the heat sealable layer coating material of Example 9, the amount of the ethylene-acrylic acid copolymer (solid content 42%) mixed was changed to 176 parts, and the amount of the carnauba wax (solid content 30%) mixed was changed to 83 parts.

Example 13

<Preparation of heat-sealable layer coating material 4>

231 parts of an ethylene-acrylic acid copolymer (solid content 42%) and 10 parts of a carnauba wax (solid content 30%) were mixed, and water was added so that the solid content concentration was 35%, followed by stirring, to obtain a heat-sealable layer coating material (concentration 35%).

<Production of Heat-Sealable Paper>

The heat-sealable layer coating material obtained was applied to general stretched paper (available from Oji Materia Co., Ltd., geometric mean of $X_1$ and $Y_1$: 178 J/m$^2$, ratio of $X_1$ to $Y_1$ ($X_1/Y_1$):1.5, and geometric mean of $X_2$ and $Y_2$: 2.1 J/g) with a basis weight of 88 g/m$^2$, a thickness of 135 μm, and a density of 0.64 g/cm$^3$ with an air knife coater so that the amount of the heat-sealable layer to be applied after drying was 10 g/m$^2$, to form a heat sealable layer.

Example 14

Heat-sealable paper was obtained in the same manner as in Example 13 except that the heat-sealable layer coating material of Example 13 was changed to a coating material prepared as follows.

<Preparation of Heat-Sealable Layer Coating Material 5>

219 parts of an ethylene-acrylic acid copolymer (solid content 42%), 10 parts of a carnauba wax (solid content 30%), and 10 parts of a 50% aqueous dispersion of kaolin A (average particle size 8 μm) were mixed, and water was added so that the solid content concentration was 35%, followed by stirring, to obtain a heat-sealable layer coating material (concentration 35%).

Example 15

<Preparation of Heat-Sealable Layer Coating Material 6>

213 parts of a styrene-butadiene copolymer (LX407-S12, available from Zeon Corporation, solid content 46%) and 6.7 parts of a paraffin wax water suspension (Hidorin L-700, available from Chukyo Yushi Co., Ltd., solid content 30%) were mixed, and water was added so that the solid content concentration was 35%, followed by stirring, to obtain a heat-sealable layer coating material (concentration 35%). The styrene-butadiene copolymer had a solubility in water at 25° C. of 10 g/L or less.

<Production of Heat-Sealable Paper>

The heat-sealable layer coating material obtained was applied to general stretched paper (available from Oji Materia Co., Ltd., geometric mean of $X_1$ and $Y_1$: 178 J/m$^2$, ratio of $X_1$ to $Y_1$ ($X_1/Y_1$):1.5, and geometric mean of $X_2$ and $Y_2$: 2.1 J/g) with a basis weight of 88 g/m$^2$, a thickness of 135 μm, and a density of 0.64 g/cm$^3$ with an air knife coater, so that the amount of the heat-sealable layer to be applied after drying was 12 g/m$^2$, to form a heat-sealable layer.

Example 16

Heat-sealable paper was obtained in the same manner as in Example 15 except that the heat-sealable layer coating material of Example 15 was changed to a coating material prepared as follows.

<Preparation of Heat-Sealable Layer Coating Material 7>

202 parts of a styrene/butadiene copolymer (LX407-S12, available from Zeon Corporation, solid content 46%), 6.7 parts of a paraffin wax water suspension (Hidorin L-700, available from Chukyo Yushi Co., Ltd., solid content 30%), and 10 parts of a 50% aqueous dispersion of kaolin A (average particle size 8 μm) were mixed, and water was added so that the solid content concentration was 35%, followed by stirring, to obtain a heat-sealable layer coating material (concentration 35%).

Example 17

Heat-sealable paper was obtained in the same manner as in Example 15 except that the paper substrate was changed to super stretched paper (available from Oji Materia Co., Ltd., geometric mean of $X_1$ and $Y_1$: 320 J/m$^2$, ratio of $X_1$ to $Y_1$ ($X_1/Y_1$):1.2, and geometric mean of $X_2$ and $Y_2$: 3.2 J/g) with a basis weight of 100 g/m$^2$, a thickness of 125 μm, and a density of 0.80 g/cm$^3$, and the amount of the heat sealable layer to be applied was changed to 8 g/m$^2$.

[Evaluation]

<Tensile Energy Absorption (TEA)>

For the heat-sealable paper of each of Examples and Comparative Examples, the tensile energy absorption in the vertical direction $X_{1a}$ and the tensile energy absorption in the horizontal direction $Y_{1a}$ were measured in accordance with JIS P 8113:2006, to calculate a geometric mean of $X_{1a}$ and $Y_{1a}$ and a ratio of $X_{1a}$ to $Y_{1a}$ ($X_{1a}/Y_{1a}$).

<Tensile Energy Absorption Index (TEAI)>

For the heat-sealable paper of each of Examples and Comparative Examples, the tensile energy absorption index $X_{2a}$ in the vertical direction and the tensile energy absorption index $Y_{2a}$ in the horizontal direction were measured in accordance with JIS P 8113:2006, to calculate a geometric mean of $X_{2a}$ and $Y_{2a}$.

<Measurement of Heat Sealing Peel Strength>

One set of heat-sealable papers was stacked so that heat sealable layers face each other and heat-sealed using a heat seal tester (TP-701-B, available from TESTER SANGYO CO., LTD.) under the conditions of 160° C., 0.2 MPa, and 1 second. Subsequently, the test specimen heat-sealed was cut into a width of 15 mm and T-peeled using a tensile tester at a tensile speed of 300 mm/min, and the maximum load recorded was taken as a heat sealing peel strength.

<Evaluation of Re-Disintegration Property (Pulp Recovery Rate after Re-Disintegration)>

Heat-sealable paper with an absolute dry mass of 30 g was torn by hand into 3 to 4 cm squares and immersed in tap water at 20° C. overnight. After dilution to a concentration of the heat-sealable paper of 2.5%, each piece was disintegrated at a rotational speed of 3000 rpm for 20 minutes using a TAPPI standard disintegrator (available from KUMAGAI RIKI KOGYO Co., Ltd.). The pulp slurry obtained was subjected to a flat screen (available from KUMAGAI RIKI KOGYO Co., Ltd.) in which a 6-cut (slit width 0.15 mm) screen plate was set and to screening in a water flow of 8.3 L/min. The undisintegrated material remaining on the screen plate was collected and dried in an oven at 105° C., and the absolute dry mass was measured, to calculate a pulp recovery rate from the following calculation formula:

Pulp recovery rate (%)={absolute dry mass (g) of heat-sealable paper tested-absolute dry mass (g) of undisintegrated material}/absolute dry mass of heat-sealable paper tested×100.

<Evaluation of Pillow Formability>

A pillow bag with a length of 15 cm and a width of 11 cm was produced from heat-sealable paper using a vertical pillow molding machine (KBF6000X2, available from KAWASHIMA PACKAGING MACHINERY LTD.) and evaluated for performance according to the following criteria.

A: A pillow bag could be formed without problems

B: A pillow bag could be formed without defects, though there is a slight difficulty to mold C: A bag shape could be formed, but there are defects such as wrinkles, loss of shape, and poor sealing D: It was impossible to form a pillow bag.

<Evaluation of Impact Resistance>

Heat-sealable paper cut into a length of 400 mm×a width of 760 mm was folded in half, so that the surfaces of heat-sealable layers face each other with a length of 400 mm×a width of 380 mm, and sealed with an impulse sealer (available from FUJI IMPULSE CO., LTD., VG-400) with a seal width of 10 mm while 3 kg of gravel was put therein, to produce five three-sided seal bags. From a height of 60 cm, each three-sided seal bag was dropped onto a concrete floor in the order of "1: Bottom corner, 2: Bottom, 3: Side, 4: Side, 5: Top, 6: Front, and 7: Back", and the breakage state of the bag was visually evaluated according to the following criteria.

A: With the portions 1 to 7 as one set, the bag did not break even if multiple sets were dropped (all the five bags did not break in multiple sets)

B: With the portions 1 to 7 as one set, the bag did not break within one set but may break in multiple sets (one or more of the five bags may break in multiple sets)

C: With the portions 1 to 7 as one set, the bag may break within one set (one or more of the five bags may break within one set)

D: With the portions 1 to 7 as one set, all the five bags broke within one set

TABLE 1-1

| | | | | Example 1 | Example 2 | Example 3 | Comparative Example 1 | Comparative Example 2 | Comparative Example 3 | Comparative Example 4 |
|---|---|---|---|---|---|---|---|---|---|---|
| Paper substrate | Type | | | Super stretched paper | Super stretched paper | Super stretched paper | Unbleached kraft paper | Unbleached kraft paper | Unbleached kraft paper | Unbleached kraft paper |
| | Basis weight | | $g/m^2$ | 100 | 80 | 100 | 80 | 100 | 120 | 130 |
| | Geometric mean of $X_1$ and $Y_1$ | | $J/m^2$ | 320 | 220 | 320 | 65 | 80 | 90 | 100 |
| | Ratio of $X_1$ to $Y_1$ ($X_1/Y_1$) | | — | 1.2 | 1.2 | 1.2 | 1.2 | 1.2 | 1.2 | 1.2 |
| | Geometric mean of $X_2$ and $Y_2$ | | J/g | 3.2 | 2.8 | 3.2 | 0.8 | 0.8 | 0.8 | 0.8 |
| Heat-sealable layer | Water-dispersible resin binder | Ethylene-vinyl acetate copolymer | Solid parts | 100 | 100 | 100 | 100 | 100 | 100 | 100 |
| | | Ethylene-acrylic acid copolymer | Solid parts | — | — | — | — | — | — | — |
| | Lubricant | Polyethylene wax | Solid parts | 20 | 20 | 20 | 20 | 20 | 20 | 20 |
| | | Carnauba wax | Solid parts | | — | — | — | — | — | — |
| | Pigment | Kaolin A | Solid parts | 10 | 10 | 10 | 10 | 10 | 10 | 10 |
| | Amount to be applied (first layer) | | $g/m^2$ | 4 | 4 | 8 | 4 | 4 | 4 | 4 |
| | Amount to be applied (second layer) | | $g/m^2$ | 4 | 4 | — | 4 | 4 | 4 | 4 |
| Heat-sealable paper | Geometric mean of $X_{1a}$ and $Y_{1a}$ | | $J/m^2$ | 318 | 220 | 318 | 65 | 80 | 90 | 100 |
| | Ratio of $X_{1a}$ to $Y_{1a}$ ($X_{1a}/Y_{1a}$) | | — | 1.4 | 1.4 | 1.4 | 1.4 | 1.4 | 1.4 | 1.4 |
| | Geometric mean of $X_{2a}$ and $Y_{2a}$ | | J/g | 3.2 | 2.8 | 3.2 | 0.8 | 0.8 | 0.8 | 0.8 |
| | Heat sealing peel strength | | N/15 mm | 7.0 | 7.0 | 7.0 | 7.0 | 8.5 | 10.0 | 10.5 |
| | Pulp recovery rate after re-disintegration | | % | 99 | 99 | 99 | 99 | 99 | 99 | 99 |
| | Pillow formability | | — | B | A | B | B | C | D | D |
| | Impact resistance | | — | A | B | A | D | C | B | A |
| | Stains of device (gravure coater) | | — | Present | Present | Present | Present | Present | Present | Present |

TABLE 1-2

| | | | | Example 4 | Example 5 | Example 6 | Example 7 | Example 8 | Example 9 | Example 10 | Example 11 | Example 12 |
|---|---|---|---|---|---|---|---|---|---|---|---|---|
| Paper substrate | Type | | | Super stretched paper | Super stretched paper | Super stretched paper | Super stretched paper | Super stretched paper | Super stretched paper | Super stretched paper | Super stretched paper | Super stretched paper |
| | Basis weight | | $g/m^2$ | 100 | 100 | 100 | 100 | 100 | 100 | 100 | 100 | 100 |
| | Geometric mean of $X_1$ and $Y_1$ | | $J/m^2$ | 320 | 320 | 320 | 320 | 320 | 320 | 320 | 320 | 320 |
| | Ratio of $X_1$ to $Y_1$ ($X_1/Y_1$) | | — | 1.2 | 1.2 | 1.2 | 1.2 | 1.2 | 1.2 | 1.2 | 1.2 | 1.2 |
| | Geometric mean of $X_2$ and $Y_2$ | | J/g | 3.2 | 3.2 | 3.2 | 3.2 | 3.2 | 3.2 | 3.2 | 3.2 | 3.2 |
| Heat-sealable layer | Water-dispersible resin binder | Ethylene-vinyl acetate copolymer | Solid parts | — | — | — | — | — | — | — | — | — |
| | | Ethylene-acrylic acid copolymer | Solid parts | 69 | 67 | 60 | 52 | 67 | 97 | 96 | 85 | 74 |
| | Lubricant | Polyethylene wax | Solid parts | — | — | — | — | — | — | — | — | — |
| | | Carnauba wax | Solid parts | 1 | 3 | 10 | 18 | 3 | 2 | 3 | 14 | 25 |
| | Pigment | Kaolin A | Solid parts | 30 | 30 | 30 | 30 | 30 | — | — | — | — |
| | Silane coupling agent | KBE-903 | Parts of effective silane | — | — | — | — | — | 1 | 1 | 1 | 1 |
| | Amount to be applied (first layer) | | $g/m^2$ | 8 | 8 | 8 | 8 | 4 | 6 | 6 | 6 | 6 |
| | Amount to be applied (second layer) | | $g/m^2$ | — | — | — | — | 4 | — | — | — | — |
| Heat-sealable paper | Geometric mean of $X_{1a}$ and $Y_{1a}$ | | $J/m^2$ | 318 | 318 | 318 | 318 | 318 | 318 | 318 | 318 | 318 |
| | Ratio of $X_{1a}$ to $Y_{1a}$ ($X_{1a}/Y_{1a}$) | | — | 1.4 | 1.4 | 1.4 | 1.4 | 1.4 | 1.4 | 1.4 | 1.4 | 1.4 |
| | Geometric mean of $X_{2a}$ and $Y_{2a}$ | | J/g | 3.2 | 3.2 | 3.2 | 3.2 | 3.2 | 3.2 | 3.2 | 3.2 | 3.2 |
| | Heat sealing peel strength | | N/15 mm | 7.3 | 7.3 | 7.3 | 7.0 | 7.3 | 6.8 | 6.8 | 6.8 | 6.8 |
| | Pulp recovery rate after re-disintegration | | % | 99 | 99 | 99 | 99 | 99 | 99 | 99 | 99 | 99 |
| | Pillow formability | | — | B | B | B | B | B | B | B | B | B |
| | Impact resistance | | — | A | A | A | A | A | A | A | A | A |
| | Stains of device (gravure coater) | | — | Absent | Absent | Absent | Absent | Absent | Absent | Absent | Absent | Absent |

TABLE 1-3

| | | | | Example 13 | Example 14 | Example 15 | Example 16 | Example 17 |
|---|---|---|---|---|---|---|---|---|
| Paper substrate | Type | | — | Stretched paper | Stretched paper | Stretched paper | Stretched paper | Super stretched paper |
| | Basis weight | | $g/m^2$ | 88 | 88 | 88 | 88 | 100 |
| | Geometric mean of $X_1$ and $Y_1$ | | $J/m^2$ | 178 | 178 | 178 | 178 | 320 |
| | Ratio of $X_1$ to $Y_1$ ($X_1/Y_1$) | | — | 1.5 | 1.5 | 1.5 | 1.5 | 1.2 |
| | Geometric mean of $X_2$ and $Y_2$ | | J/g | 2.1 | 2.1 | 2.1 | 2.1 | 3.2 |
| Heat-sealable layer | Water-dispersible resin binder | Ethylene-vinyl acetate copolymer | Solid parts | — | — | — | — | — |
| | | Ethylene-acrylic acid copolymer | Solid parts | 97 | 92 | — | — | — |
| | | Styrene/butadiene copolymer | Solid parts | — | — | 98 | 93 | 98 |
| | Lubricant | Polyethylene wax | Solid parts | — | — | — | — | — |
| | | Carnauba wax | Solid parts | 3 | 3 | — | — | — |
| | | Paraffin wax | Solid parts | — | — | 2 | 2 | 2 |
| | Pigment | Kaolin A | Solid parts | — | 5 | — | 5 | — |
| | Silane coupling agent | KBE-903 | Parts of effective silane | — | — | — | — | — |
| | Amount to be applied (first layer) | | $g/m^2$ | 10 | 10 | 12 | 12 | 8 |
| | Amount to be applied (second layer) | | $g/m^2$ | — | — | — | — | — |
| Heat-sealable paper | Geometric mean of $X_{1a}$ and $Y_{1a}$ | | $J/m^2$ | 204 | 204 | 204 | 204 | 342 |
| | Ratio of $X_{1a}$ to $Y_{1a}$ ($X_{1a}/Y_{1a}$) | | — | 1.4 | 1.4 | 1.4 | 1.4 | 1.4 |
| | Geometric mean of $X_{2a}$ and $Y_{2a}$ | | J/g | 2.1 | 2.1 | 2.1 | 2.1 | 3.2 |
| | Heat sealing peel strength | | N/15 mm | 6.1 | 6.1 | 6.6 | 6.5 | 6.9 |
| | Pulp recovery rate after re-disintegration | | % | 90 | 95 | 96 | 99 | 99 |
| | Pillow formability | | — | B | B | B | B | B |
| | Impact resistance | | — | A | A | A | A | A |
| | Stains of device (gravure coater) | | — | Absent | Absent | Absent | Absent | Absent |

Table 1 above shows the results. The heat sealable papers of Examples 1 to 17 were excellent in pillow formability and impact resistance. Meanwhile, the heat-sealable papers of Comparative Examples 1 to 4 were poor in at least one of pillow formability and impact resistance. When the heat sealable layer was applied, staining of the device (gravure coater) was observed in Examples 1 to 3, whereas no staining of the device was observed in Examples 4 to 17.

The invention claimed is:

1. A heat-sealable paper comprising:

a paper substrate; and at least one heat-sealable layer formed on at least one surface of the paper substrate, wherein the paper substrate comprises raw material pulp containing softwood pulp as a main component and a dry paper strength additive, the heat-sealable layer comprises a water-dispersible resin binder and a lubricant, the water-dispersible resin binder comprises at least one selected from the group consisting of an ethylene-(meth)acrylic acid copolymer and a styrene/butadiene copolymer, in which, when the water-dispersible resin binder comprises the ethylene-(meth)acrylic acid copolymer, the lubricant comprises carnauba wax, or when the water-dispersible resin binder comprises the styrene/butadiene copolymer, the lubricant comprises paraffin wax, and in the paper substrate, when a tensile energy absorption in a longitudinal direction of the paper substrate as measured in accordance with JIS P 8113:2006 is defined as $X_1$, a tensile energy absorption in a transverse direction of the paper substrate as measured in accordance with JIS P 8113:2006 is defined as $Y_1$, a tensile energy absorption index in the longitudinal direction as measured in accordance with JIS P 8113:2006 is defined as $X_2$, and a tensile energy absorption index in the transverse direction as measured in accordance with JIS P 8113:2006 is defined as $Y_2$, a geometric mean of $X_1$ and $Y_1$ is 120 $J/m^2$ or more, a ratio of $X_1$ to $Y_1$ ($X_1/Y_1$) is 0.5 or more and 2.0 or less, and a geometric mean of $X_2$ and $Y_2$ is 2.0 J/g or more.

2. The heat-sealable paper according to claim 1, wherein the content of the lubricant in the heat-sealable layer is 0.2 mass % or more and 30 mass % or less.

3. The heat-sealable paper according to claim 1, wherein the heat-sealable layer further comprises at least one selected from a pigment and a silane coupling agent.

4. The heat-sealable paper according to claim 1, having a pulp recovery rate after re-disintegration of 85% or more.

5. A packaging bag using the heat-sealable paper according to claim 1.

6. The heat-sealable paper according to claim 1, wherein the paper substrate satisfies at least one selected from requirements 1 to 3, Requirement 1: the raw material pulp constituting the paper substrate is unbleached kraft pulp, Requirement 2: the pulp constituting the paper substrate has a kappa number as measured in accordance with JIS P 8211:2011 of 30 or more and 60 or less, and Requirement 3: the paper substrate has a basis weight of 120 g/m$^2$ or less.

7. A heat-sealable paper comprising:

a paper substrate; and at least one heat-sealable layer formed on at least one surface of the paper substrate, wherein the paper substrate comprises raw material pulp containing softwood pulp as a main component and a dry paper strength additive, the heat-sealable layer comprises a water-dispersible resin binder and a lubricant, the water-dispersible resin binder comprises at least one selected from the group consisting of an ethylene-(meth)acrylic acid copolymer and a styrene/butadiene copolymer, in which, when the water-dispersible resin binder comprises the ethylene-(meth)acrylic acid copolymer, the lubricant comprises carnauba wax, or when the water-dispersible resin binder comprises the styrene/butadiene copolymer, the lubricant comprises paraffin wax, and in the heat-sealable paper, when a tensile energy absorption in a longitudinal direction of the heat-sealable paper as measured in accordance with JIS P 8113:2006 is defined as $X_{1a}$, a tensile energy absorption in a transverse direction of the heat-sealable paper as measured in accordance with JIS P 8113:2006 is defined as $Y_{1a}$, a tensile energy absorption index in the longitudinal direction as measured in accordance with JIS P 8113:2006 is defined as $X_{2a}$, and a tensile energy absorption index in the transverse direction as measured in accordance with JIS P 8113:2006 is defined as $Y_{2a}$, a geometric mean of $X_{1a}$ and $Y_{1a}$ is 120 J/m$^2$ or more, a ratio of $X_{1a}$ to $Y_{1a}$ ($X_{1a}/Y_{1a}$) is 0.5 or more and 2.0 or less, and a geometric mean of $X_{2a}$ and $Y_{2a}$ is 2.0 J/g or more.

8. A packaging bag using the heat-sealable paper according to claim 7.

9. The heat-sealable paper according to claim 7, wherein the paper substrate satisfies at least one selected from requirements 1 to 3, Requirement 1: the raw material pulp constituting the paper substrate is unbleached kraft pulp, Requirement 2: the pulp constituting the paper substrate has a kappa number as measured in accordance with JIS P 8211:2011 of 30 or more and 60 or less, and Requirement 3: the paper substrate has a basis weight of 120 g/m$^2$ or less.

10. The heat-sealable paper according to claim 7, wherein the content of the lubricant in the heat-sealable layer is 0.2 mass % or more and 30 mass % or less.

11. The heat-sealable paper according to claim 7, wherein the heat-sealable layer further comprises at least one selected from a pigment and a silane coupling agent.

12. The heat-sealable paper according to claim 7, having a pulp recovery rate after re-disintegration of 85% or more.

* * * * *